United States Patent [19]

Focke

[11] Patent Number: 4,607,748

[45] Date of Patent: Aug. 26, 1986

[54] SHOULDER BOX FOR CIGARETTES OR THE LIKE

[75] Inventor: Heinz Focke, Verden, Fed. Rep. of Germany

[73] Assignee: Focke & Co., Verden, Fed. Rep. of Germany

[21] Appl. No.: 640,918

[22] Filed: Aug. 15, 1984

[30] Foreign Application Priority Data

Aug. 16, 1983 [DE] Fed. Rep. of Germany ..... 3329454

[51] Int. Cl.[4] ..... B65D 5/72

[52] U.S. Cl. ..... 206/254; 206/273; 206/804; 229/87 C

[58] Field of Search ..... 206/249, 254, 265, 268, 206/271-274, 804, 443; 220/403; 229/87 C

[56] References Cited

U.S. PATENT DOCUMENTS

| | | | |
|---|---|---|---|
| 1,268,164 | 6/1918 | Schneider | 206/265 |
| 1,310,949 | 7/1919 | Harms | 206/254 |
| 1,488,044 | 3/1924 | Harms | 206/254 |
| 1,863,190 | 6/1932 | Coulapides | 206/273 |
| 2,046,484 | 7/1936 | Ringler | 206/273 |
| 2,113,277 | 4/1938 | Muller | 206/273 |
| 2,346,407 | 4/1944 | Wright | 206/254 |
| 3,596,823 | 8/1971 | Zitzelman | 206/273 |

FOREIGN PATENT DOCUMENTS

| | | | |
|---|---|---|---|
| 0632532 | 6/1936 | Fed. Rep. of Germany | 206/265 |
| 2143596 | 3/1972 | Fed. Rep. of Germany | 206/268 |
| 1297965 | 5/1962 | France | 206/804 |
| 0427348 | 4/1935 | United Kingdom | 206/265 |
| 1254695 | 11/1971 | United Kingdom | 206/271 |

*Primary Examiner*—William Price
*Assistant Examiner*—Jimmy G. Foster
*Attorney, Agent, or Firm*—Sughrue, Mion, Zinn, Macpeak and Seas

[57] ABSTRACT

Shoulder boxes consist of a box part (10) for receiving a group of cigarettes (16) or the like and of a hinge lid (11) connected via an axis of articulation (12). An inner blank (17) with improved moisture and aroma retention is provided with a fold-free upper wall (19) which is closed from stock and in which an extraction orifice (30), extending up to one end of the cigarettes (16) and covering a part region of approximately one third of the surface of the upper wall (19), is provided. This extraction orifice is covered by a closing flap (31) which is formed with an overlapping edge strip (32) at least at one edge located opposite the point of articulation.

4 Claims, 8 Drawing Figures

Figure 6:
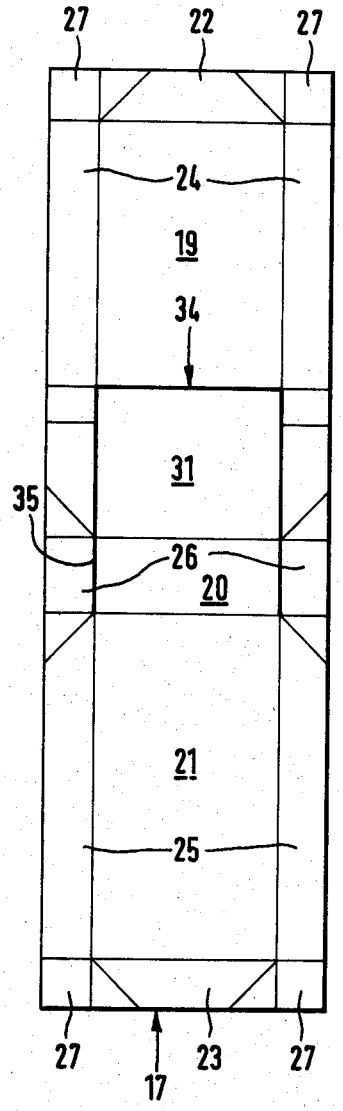

Fig. 1
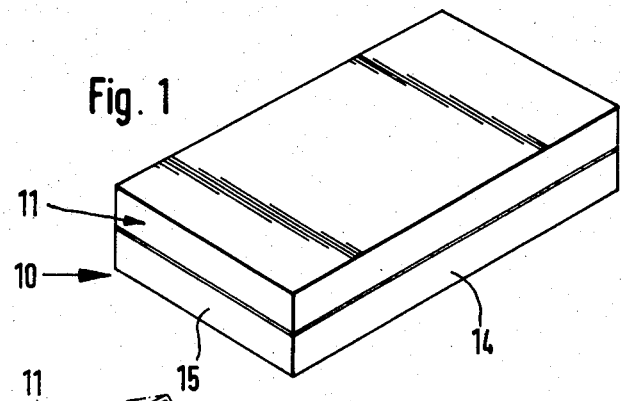
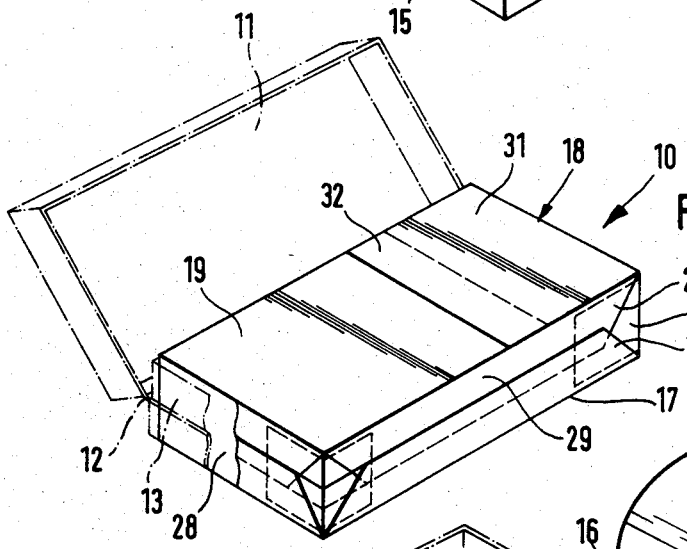
Fig. 2
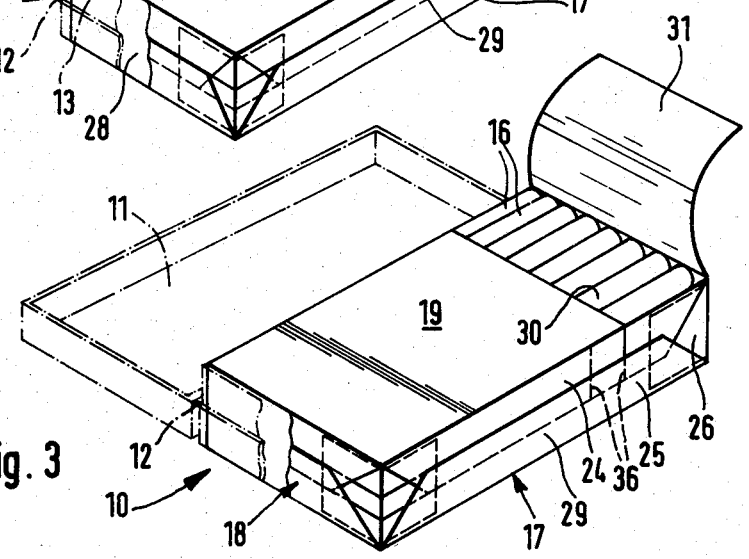
Fig. 3

Fig. 4
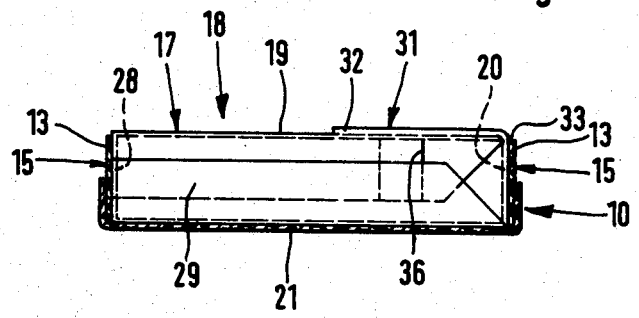
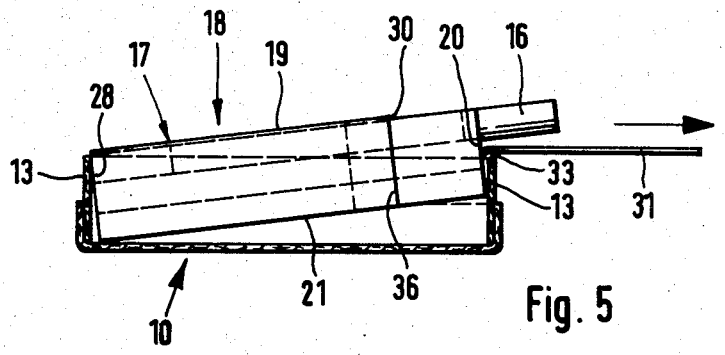
Fig. 5

SHOULDER BOX FOR CIGARETTES OR THE LIKE

DESCRIPTION

The invention relates to a pack with a box part and with a hinge lid connected to the latter via an axis of articulation (so-called shoulder box), for receiving a group of cigarettes or the like wrapped in an inner blank consisting especially of tin foil, the cigarettes being aligned so as to lie flat in the box part.

Shoulder boxes consist predominantly of relatively stiff cardboard. The cigarettes are aligned in the box part so as to lie flat, conventionally in two layers on top of one another. In the closed position, this box part is surrounded by the hinge lid along an edge set back inwards.

In shoulder boxes of this type, the group of cigarettes is wrapped in an inner blank consisting conventionally of tin foil with an inner layer of glassine ply. The inner blank is designed and arranged so that the upper side, that is to say an upper wall resting on the upper side of the cigarettes, consists of at least two closing tabs overlapping one another but not connected to one another. To extract cigarettes, these are swung to one side, so that the complete surface of the cigarettes or the upper layer of the cigarette group is exposed. To close the shoulder box again, the closing tabs are folded back into the initial position.

A pack of this type or an inner blank designed in this way allows for greater losses of aroma and moisture from the cigarette tobacco. Another disadvantage is that the entire (upper) layer of cigarettes is always exposed when the pack is opened. Finally, because of its constructive design the inner blank is unsuitable for holding the group of cigarettes together sufficiently.

The object on which the invention is based is to propose a pack with an inner blank for cigarettes or the like, in particular a shoulder box, in which the abovementioned disadvantages are avoided. In particular, the inner blank will confer on the cigarettes greater protection against losses of moisture and aroma before and after the pack is used. At the same time, it will become easier to handle the pack, in particular extract cigarettes.

To achieve this object, the pack according to the invention is defined in that an upward-directed wall of the inner blank (upper wall) has an extraction orifice which is formed as a result of stamping and extends up to an edge of the upper wall facing one end of the cigarettes and which is covered by a closing flat of at least the size of the extraction orifice.

The extraction orifice, formed according to the invention in the otherwise closed upper wall, is arranged off-center, in particular at an edge of the surface of the upper wall facing one end of the cigarettes, and specifically preferably over the entire width of the upper wall. As a result, when the closing flat is folded back, the cigarettes can easily be grasped at their ends and pulled out of the otherwise closed inner blank. For this purpose, the closing flap can be pulled over the free transverse edge of the box part of the shoulder box, in such a way that the group of cigarettes is lifted on one side of the inner blank and it thereby becomes easier to grasp a cigarette.

According to a further important feature of the invention, the closing flap is made larger than the extraction orifice, specifically in such a way that the closing flap covers by means of an edge strip a region bordering the extraction orifice, in particular transversely to the cigarettes. Since the closing flap on the one hand and the extraction orifice on the other hand are formed as a result of U-shaped stamping in the inner blank, the overlapping edge strip of the closing flap is produced as a result of an effective shortening of the inner blank in a region adjacent to the extraction orifice, specifically, in particular, by means of a Z-shaped fold in longitudinal side tabs laterally adjacent to the extraction orifice.

The elongate rectangular inner blank is folded round the group of cigarettes in the form of a U, in such a way that a continuously closed end wall is formed adjacent to the extraction orifice or to the closing flap and opposite this an end wall formed from trapezoidal end-wall tabs is obtained. The side walls are formed from longitudinal side tabs which partially overlap one another.

An inner wrapping (inner blank) designed in this way is easy to operate in mechanical terms. Furthermore, a substantially closed wrapping for the cigarette group is formed, in a way which is otherwise customary in hinge-lid packs only.

Further features of the invention relate to the constructive design of the inner blank.

Figure 7:
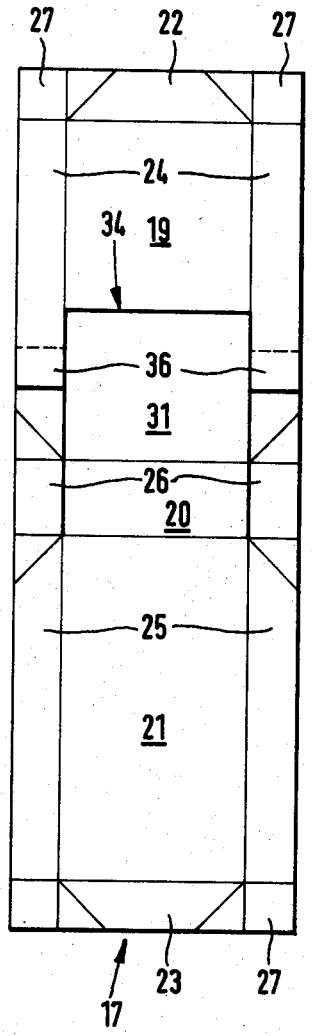
Figure 8:
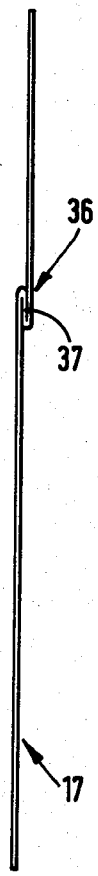

An exemplary embodiment of the invention is explained in more detail below with reference to the drawings in which:

FIG. 1 shows a shoulder box in a simplified perspective representation,

FIG. 2 shows the opened shoulder box with a tin foil block, likewise in a perspective representation, FIG. 3 shows a representation corresponding to FIG. 2, with the extraction orifice of an inner blank exposed, FIG. 4 shows a longitudinal section through the pack or tin foil block in the closed position, FIG. 5 shows a position for the extraction of a cigarette, in a longitudinal section corresponding to FIG. 4, FIG. 6 shows a spread-out inner blank for the pack according to FIGS. 1 to 5, FIG. 7 shows the shortened blank prepared for wrapping a group of cigarettes, FIG. 8 shows a longitudinal section through the inner blank according to FIG. 7, in the region of longitudinal side tabs.

In FIG. 1, a pack of the shoulder-box type is shown in a highly diagrammatic representation. The should box consists conventionally of a box part 10 and a hinge lid 11. The latter is connected pivotably to the box part 10 in the region of an axis of articulation 12. In the closed position, the hinge lid 11 surrounds a shoulder which is formed on the box part 10 and which runs all round and is set back inwards relative to the remaining part of the box part 10. In the exemplary embodiment illustrated, this shoulder is formed by a collar 13 arranged on the inside of the box part and running all round. This collar extends over the full height of longitudinal walls 14 and transverse walls 15 of the box part.

A group of cigarettes 16 is received within the box part 10 designed in this way. In the example illustrated, these are aligned parallel to the axis of articulation 12. Furthermore, three layers of cigarettes are arranged on top of one another here. This results in a cuboid shoulder box which has the format of a conventional hinge-lid pack.

The group of cigarettes 16 is wrapped in an inner blank 17 consisting of tin foil or the like, so that a tin foil block 18 is formed as the pack content. As a spread-out initial product (FIG. 6), the inner blank 17 is of elongate rectangular shape. Regions or zones for forming an upper wall 19, an end wall 20 and a lower wall 21 are arranged in succession in the longitudinal direction of the blank. End-wall tabs 22 and 23 adjoin the upper wall 19 and the lower wall 21 in the longitudinal direction at the free ends. On the sides, longitudinal side tabs 24 and 25 are located on each of the two sides in the region of the upper wall 19 and the lower wall 21. These are continued as corner tabs 26 and 27 in the region of the closed end wall 20 and the end-wall tabs 22 and 23.

The inner blank 17 designed in this way is folded in the form of a U from one end of the group of cigarettes round the latter, in such a way that the end wall 20 remains closed and free of folds. Opposite this, an end wall 28 is formed from the end-wall tabs 22 and 23. These are folded over in a trapezoidal form so as to overlap one another partially. Likewise, side walls 29 of the tin foil block 18 are formed by the longitudinal side tabs 24 and 25 when the latter are folded over so as to overlap one another. As shown in FIG. 3, the corner tabs 26 adjacent to the end wall 20 are folded into the plane of the side wall 29.

An extraction orifice 30 is formed in the region of the otherwise continuous upper wall 19 free of folds. This extraction orifice is arranged off-center, and in particular is assigned to one end of the cigarettes 16. It extends over the full width of the upper wall 19 and, in the longitudinal direction of the cigarettes 10, up to the adjacent transverse wall 15 of the box part 10.

In the closed position, the extraction orifice 30 is covered by a closing flap 31 which is formed from the inner blank 17 itself, and specifically by the region of the latter corresponding to the extraction orifice 30. Accordingly, the closing flap 31 extends over the full width of the extraction orifice 30. In the longitudinal direction (of the cigarettes), the closing flap 31 has larger dimensions than the extraction orifice 30. As a result, in the closed position, the closing flap 31 rests by means of an edge strip 32 on the adjacent part of the upper wall 19, that is to say on a strip-shaped portion adjacent to the extraction orifice 30. The edge strip 32 rests loosely on the upper wall 19, but can also be attached to the upper wall 19 by means of a releasible connection, for example a peel-seal strip.

For the extraction of cigarettes, the closing flap 31 is first swung back into the position according to FIG. 3 by hand. The closing flap 31 can then be pulled over an upper edge 33 of the box part 10 or of the collar 13 in the region of the transverse wall 15. When a pull is exerted, the tin foil block 18 is lifted on one side into the position according to FIG. 5. A considerable region of the end wall 20 thereby projects from the box part 10, so that at least one cigarette 10 of the upper layer can easily be extracted. The remaining cigarettes stay in the fan-like inner blank 17.

The extraction orifice 30 and closing flap 31 are formed as a result of U-shaped stamping 34 in the inner blank 17 (FIGS. 6 and 7). Here, the stamped portion 34 extends with its legs to the edge of the upper wall 19, but by means of an extension 35 is continued into the region of the end wall 20, in particular along its sides. In the exemplary embodiment illustrated, the extensions 35 of the stamped portion 34 extend over the full height of the end wall 20.

Within the blank, the extraction orifice 30 is limited laterally by the longitudinal side tabs 24. To provide the overlapping edge strip 32 of the closing flap 31, the inner blank 17 has to be "shortened" in the region of the extraction orifice 30. For this purpose, in the preferred exemplary embodiment of the pack illustrated, a Z-shaped fold 36 causing the shortening is formed in the two longitudinal side tabs 24. This is obtained by pushing regions of the longitudinal side tabs 24 over one another, in such a way that an intermediate strip 37 is pushed between outer and inner layers of the longitudinal side tabs 24. The width of the Z-shaped fold or of the intermediate strip 37 corresponds to the width of the edge strip 32 of the closing flap 31. The finished pack is not impaired by the Z-shaped fold 36, since it is located within the box part 10, in particular between the group of cigarettes 16, on the one hand, and the longitudinal walls 14 of the pack, on the other hand.

In the closed position, the closing flap 31 can rest on the cigarettes 16 "loosely", that is to say without connection. However, it is also possible to connect the projecting edge stip 32 releasibly to the covered part of the upper wall 19, for example by means of a glue (peel-seal).

I claim:

1. A cigarette pack comprising:

a shoulder box having a box portion (10) for cigarettes said box portion having a shoulder part (13), and a lid (11) pivotably attached to said box portion said lid surrounding said shoulder part when in the closed position; and an inner wrapping for encasing the cigarettes to be stored in said box portion, said inner wrapping being shaped to fit within said box portion and having longitudinally extending first and second side walls (29, 29), transversely extending first (28) and second (20) end walls, a lower wall (21) extending in the lengthwise direction from said first end wall to said second end wall and in the widthwise direction from said first side wall to the second side wall, and an upper wall (19) extending in the widthwise direction from said first side wall to said second side wall and in the lengthwise direction from said first end wall a distance less than the length of said lower wall to form a cigarette removal opening (30), said opening extending longitudinally from the transverse edge of said upper wall furthest from said first end wall to said second end wall and transversely from said first side wall to said second side wall, and a closing flap (31) extending longitudinally from said second end wall a distance greater than the longitudinal dimension of said opening to form an edge strip (32) which at least partially overlaps said upper wall;

wherein each of said side walls (29) is comprised of first (24) and second (25) overlapping side tab portions said first side tab portion being an extension of said upper wall, said second side tab portion being an extension of said lower wall and wherein said first tab portion is provided with a Z-shaped fold in its longitudinal direction, said fold having a longitudinal dimension equal to that of said edge strip.

2. The pack as claimed in claim 1, wherein said second end wall has a lower transverse edge connected to said lower wall, an upper transverse edge connected to said closing flap, and first and second side edges perpendicular to said transverse edges and adjacent to but unconnected to said first and second side walls (29, 29).

3. The pack as claimed in claim 2, wherein said first end wall includes first and second side edges connected, respectively, to said first and second side walls.

4. A cigarette pack comprising:

a shoulder box having a box portion (10) for cigarettes said box portion having a shoulder part (13), and a lid (11) pivotably attached to said box portion said lid surrounding said shoulder part when in the closed position; and an inner wrapping for encasing the cigarettes to be stored in said box portion, said inner wrapping being shaped to fit within said box portion and having longitudinally extending first and second side walls (29, 29), transversely extending first (28) and second (20) end walls, a lower wall (21) extending in the lengthwise direction from said first end wall to said second end wall and in the widthwise direction from said first side wall to the second side wall, an an upper wall (19) extending in the widthwise direction from said first side wall to said second side wall and in the lengthwise direction from said first end wall a distance less than the length of said lower wall to form a cigarette removal opening (30), said opening extending longitudinally from the transverse edge of said upper wall furthest from said first end wall to said second end wall and transversely from said first side wall to said second side wall, and a closing flap (31) extending longitudinally from said second end wall a distance greater than the longitudinal dimension of said opening to form an edge strip (32) which at least partially overlaps said upper wall;

wherein said first end wall (28) is comprised of partially overlapping first (22) and second (23) end tab portions said first end tab portion being an extension of said upper wall, said second end tab portion being an extension of said lower wall and said second end wall is an extension of said lower wall.

* * * * *